US005233122A

United States Patent [19]

Kim

[11] Patent Number: 5,233,122

[45] Date of Patent: Aug. 3, 1993

[54] GUITAR WITH NECK TRUSS ROD SUPPORTING CONSTRUCTION

[75] Inventor: Jin Y. Kim, Kyunggi, Rep. of Korea

[73] Assignee: Saehan Music Co., Ltd., Kyunggi, Rep. of Korea

[21] Appl. No.: 908,053

[22] Filed: Jul. 6, 1992

[30] Foreign Application Priority Data

Jul. 5, 1991 [KR] Rep. of Korea ..... 91/10230

[51] Int. Cl.[5] ..... G10D 3/00

[52] U.S. Cl. ..... 84/293

[58] Field of Search ..... 84/275, 290, 291, 293

[56] References Cited

U.S. PATENT DOCUMENTS 4,172,405 10/1979 Kraman ..... 84/293

4,200,023 4/1980 Kaman ..... 84/293

*Primary Examiner*—Michael L. Gellner

*Assistant Examiner*—P. Stanzione

*Attorney, Agent, or Firm*—Fisher, Christen & Sabol

[57] ABSTRACT

A guitar comprising a neck truss rod supporting construction capable of firmly coupling its elements, such as a fret board, a neck, a guitar body and a front board of the guitar body, with one another. The neck truss rod supporting construction includes a truss rod supporting member, an extension member providing a wide bonding area and a coupling member having a cross-sectional shape of a trapezoid rotated 90° and engaged in a block of the guitar body in a dovetail manner. The extension member has upper walls extending transversely and defining recesses among them. The front board of guitar body also has an opening engaged with the upper walls of extension member in a fit manner. At upper surfaces of the truss rod supporting member and the extension member, a plurality of longitudinal shallow slots are formed to provide positive bonding surfaces. The truss rod support construction does not move relatively to the guitar body and the neck, so that any relative movement between the truss rod and the neck does not occur even when a variation in the moisture content of the wood material of the neck occurs. Moreover, there is no any phenomenons such as cracking or bowing of the neck.

1 Claim, 3 Drawing Sheets 1
2
2A
2B
2C
2D
2b
2b'
3
4
5
5'
6
7
7'
7"
7'''
8
8'
8"
9
10
10'
11
11'

GUITAR WITH NECK TRUSS ROD SUPPORTING CONSTRUCTION

BACKGROUND OF THE INVENTION

1. Field of the Invention

The present invention relates to a guitar, and more particularly to a guitar with a neck truss rod supporting construction.

2. Description of the Prior Art

In guitars of the type including a body having a resonating sound chamber and a neck both of which are made from wood, the neck is subjected to warpage from the factors such as the tension of tightened strings, the external heat and the external force. Where the neck is bowed, a fret board can not align horizontally with the front board of the guitar body. This may cause a deterioration in acoustic quality. To compensate for the factors, in particular, the string tension, an adjustable truss rod has been conventionally inserted into the neck to straighten the bowed neck, thereby enabling the fret board to align horizontally with the front board of the guitar body. The truss rod is supported to the neck by means of a truss rod supporting member fitted to a block fixed to the guitar body.

In cases of guitars of the type including an elongate neck, the constructional firmness thereof is insufficient because of a small bonding area between the fret board and the front board of the guitar body. Furthermore, the bonding between the fret board and the front board of the guitar body often becomes poor. Due to the provision of the truss rod, there is also a problem as to the constructional firmness. That is, since the truss rod is supported to the neck only by means of the supporting member fitted to the block fixed to the guitar body, a relative movement between the truss rod and the neck tends to occur due to a variation in the moisture content of the wood material of the neck. Moreover, phenomenons such as cracking or bowing of the neck may occur.

SUMMARY OF THE INVENTION

Therefore, an object of the invention is to provide a guitar with a neck truss rod supporting construction capable of firmly coupling its elements, such as a fret board, a neck, a guitar body and a front board of the guitar body, with one another, thereby achieving an improvement in constructional firmness.

In accordance with the present invention, this object can be accomplished by providing a guitar comprising a guitar body having a front board and a side board, a neck having a slot receiving a truss rod and a neck truss rod supporting construction, and a fret board attached to the neck, characterized in that said neck truss rod supporting construction comprises: an elongate, truss rod supporting member adapted to support said truss rod and provided at its rear end with a heel extending downwardly and at its upper surface with a plurality of longitudinal shallow slots for forming a bonding surface; a coupling member formed at the rear end of the truss rod supporting member behind said heel and integrally connected to the heel, said coupling member extending downwardly from the truss rod supporting member and has a cross-sectional shape of a trapezoid rotated 90°; an extension member integrally formed with the truss rod supporting member behind the coupling member and provided with a plurality of upper walls extending transversely and defining recesses among them, said extension member also having a plurality of longitudinal shallow slots for forming a bonding surface at an upper surface defined by all the upper walls; a plurality of throughout holes formed in at least one of the upper walls of the extension member and each adapted to receive a nail or screw; reinforcing members mounted beneath at least one of the upper walls at both sides of the extension member and adapted to reinforce the upper wall; a block fixedly mounted to the side board in the guitar body and provided with a first groove having the same cross-sectional shape as that of the coupling member and receiving the coupling member and a second groove receiving the extension member; and an opening formed at the front board of the guitar body and having the same shape as that of the upper surface of the extension member.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

Figures 1, 2A, 2B, 2C, 2D:
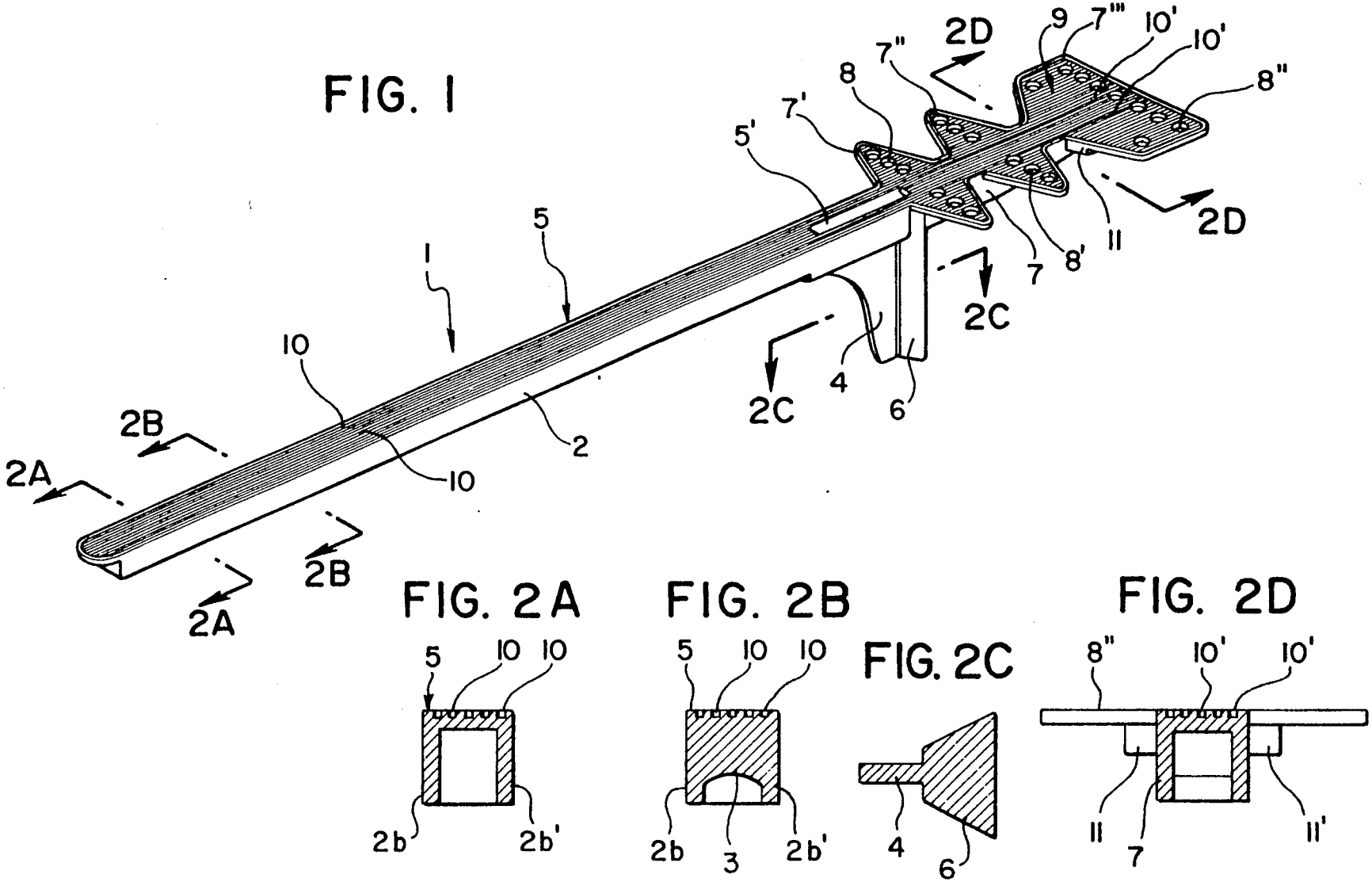
FIG. 1 is a perspective view of a neck truss rod supporting construction of a guitar in accordance with the present invention.
FIG. 2A is a cross-sectional view taken along the line A—A in FIG. 1.
FIG. 2B is a cross-sectional view taken along the line B—B in FIG. 1.
FIG. 2C is a cross-sectional view taken along the line C—C in FIG. 1.
FIG. 2D is a cross-sectional view taken along the line D—D in FIG. 1.

Referring to FIG. 1, there is illustrated a neck truss rod supporting construction of a guitar in accordance with the present invention.

Figure 4:
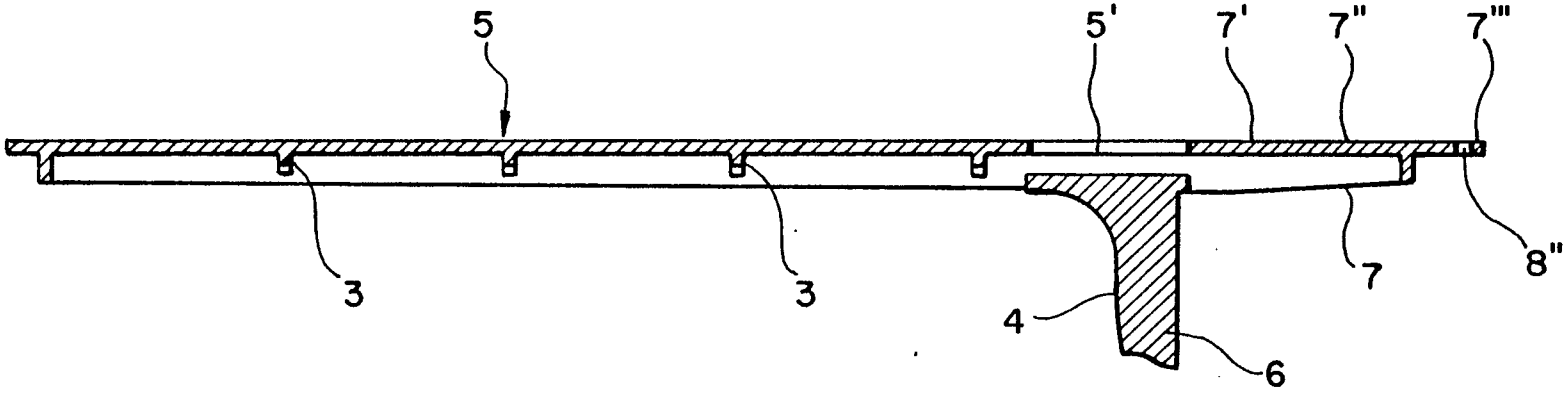
FIG. 4 is a sectional view of the neck truss rod supporting construction according to the present invention.

As shown in FIG. 1, the neck truss rod supporting construction which is designated by the reference numeral 1 comprises an elongate, truss rod supporting member 2 adapted to support a truss rod (not shown) and provided with an upper wall 2*a* and a pair of opposite side walls 2*b* and 2*b'* (FIG. 2A), and a heel 4 provided at the rear end (namely, the right end in FIG. 1) of the truss rod supporting member 2 and extending downwardly therefrom. The truss rod supporting member 2 also has a plurality of spaced ribs 3 arranged along the length of the truss rod supporting member 2 and extending downwardly from the bottom surface of the upper wall 2*a*, as shown in FIGS. 2B and 4. At the upper surface of the upper wall 2*a*, a bonding surface 5 is provided, which is formed by a plurality of longitudinal shallow slots 10 formed on the upper surface of the upper wall 2*a*, as shown in FIGS. 2A and 2B. Behind the heel 4, a coupling member 6 is formed at the rear end of the truss rod supporting member 2 and integrally connected to the heel 4. The coupling member 6 extends downwardly from the truss rod supporting member 2 and has a cross-sectional shape of a trapezoid rotated 90°, as shown in FIG. 2C.

Behind the coupling member 6, an extension member 7 is integrally formed with the truss rod supporting member 2. The extension member 7 has a plurality of upper walls 7', 7'' and 7''' (three in case of the illustrated embodiment) extending transversely to provide a wide bonding surface. Adjacent upper walls of the extension member 7 define recesses to provide a mechanical coupling between the extension member 7 and a guitar body. In similar to the upper wall 2*a* of the truss rod supporting member 2, a plurality of longitudinal shallow slots 10' are formed at the upper surface of the extension member 7, so as to provide a bonding surface 9. Each upper wall 7' (or 7'', or 7''') has a plurality of throughout holes 8 (or 8', or 8'') which permit a coupling between a fret board and a front board of the guitar body using nails or screws. In order to reinforce the upper walls of the extension member 7, reinforcing members may be mounted beneath the upper walls at both sides of the extension member 7. In the illustrated embodiment, a pair of reinforcing members 11 and 11' are provided beneath the upper wall 7'''.

A recess 5' is also provided between the bonding surface 5 of the truss rod supporting member 2 and the bonding surface 9 of the extension member 7.

In the drawings, the reference numeral 12 designates the fret board, 13 the neck, 13' a slot formed in the neck 13 to receive the neck truss rod supporting construction 1, 15 a guitar body in which a resonating sound chamber is formed, 14 the front board of the guitar body, and 16 a side board of the guitar body 15.

In the guitar body 15, a block 17 is fixedly mounted to the side board 16 of the guitar body 15 and adapted to firmly support the neck truss rod supporting member 2. The block 17 has a first groove 18 having the same cross-sectional shape as that of the coupling member 6 and receiving the coupling member 6 and a second groove 19 receiving the extension member 7.

On the other hand, the front board 14 of the guitar body 15 provided with an opening having the same shape as that of the upper surface of the extension member 7.

This neck truss rod supporting construction 1 with the above-mentioned structure functions to support an adjustable truss rod which is adapted for straightening the neck 13, when the fret board 12 does not align horizontally with the front board 14 of the guitar body 15, due to a bowing of the neck caused by the tension of tightened strings, the external heat or the external force, thereby causing the acoustic quality to be deteriorated.

Figure 3:
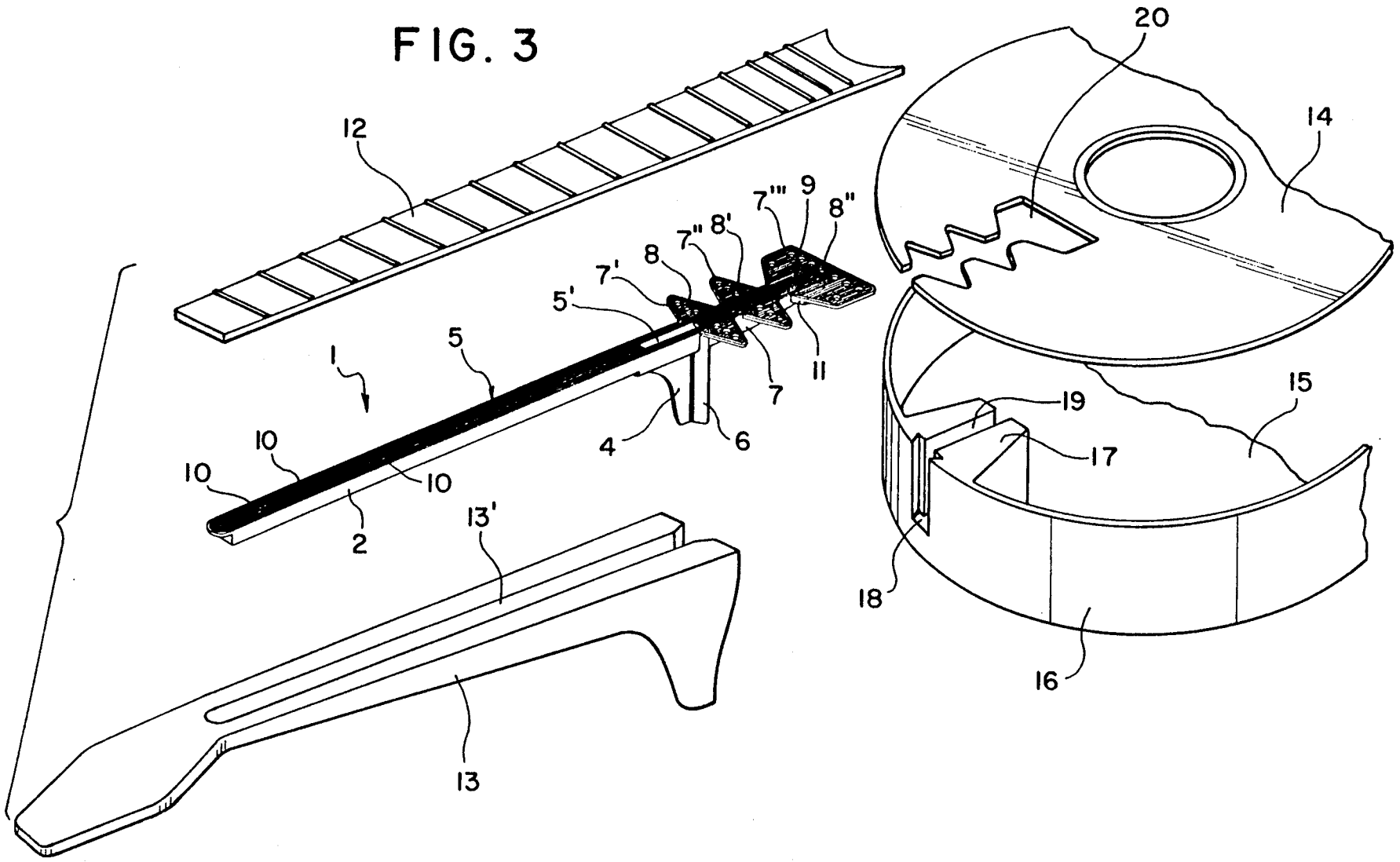
FIG. 3 is an exploded perspective view of a guitar with the neck truss rod supporting construction according to the present invention.

Now, assembling of the neck truss rod supporting construction with the neck and the guitar body will be described in detail, in conjunction with FIG. 3.

Upon assembling the neck truss rod supporting construction 1 with the guitar body 15 to which the neck 13 has been previously bonded, the neck truss rod supporting construction 1 is first inserted in the neck 13. At this time, the truss rod supporting member 2 is received in the slot 13' of the neck 13 while the heel 4 is fitted to a vertical groove formed at the neck 13 behind the rear end of the slot 13'. Also, the coupling member 6 is fitted to the first groove 18 of the block 17 while the extension member 7 is received in the second groove 19 of the block 17. On the other hand, the upper walls 7', 7'' and 7''' of the extension member 7 is engaged in the opening 20 of the front board 14.

In order to provide an adhesion between the neck truss rod supporting construction 1 and both of the neck 13 and the guitar body 15, surface portions of the neck truss rod supporting construction 1 to come into contact with both of the neck 13 and the guitar body 15 have been applied with an adhesive, prior to the assembling.

Thereafter, an adhesive is applied to the upper surface of the neck 13, the bonding surface 5 of the truss rod supporting member 2 and the bonding surface 9 of the extension member 7. The fret board 12 is then attached to the bonding surface 5 of the truss rod supporting member 2 and the bonding surface 9 of the extension member 7. At this time, the adhesive is penetrated into the slots 10 and 10' and the throughout holes 8, 8' and 8''.

Since the adhesive is penetrated into the slots 10 and 10' and the throughout holes 8, 8' and 8'' as mentioned above and the extension member 7 provides a wide bonding area, the fret board 12 can be more firmly fixed to all of the neck truss rod supporting member 2, the neck 13 and the guitar body 15. In particular, since the coupling member 6 is engaged in the first groove 18 of the block 17 in a dovetail manner and the upper walls 7', 7'' and 7''' of the extension member 7 are also engaged in the opening 20 of the front board 14 in a fit manner, the truss rod support construction 1 and thus the fret board do not move relatively to the guitar body 15 and the neck 13, so that any relative movement between the truss rod and the neck does not occur even when a variation in the moisture content of the wood material of the neck occurs. If desired, nails or screws may be fitted in throughout holes 8, 8' and 8'' formed at the extension member 7, to provide more improved constructional firmness.

As apparent from the above description, the present invention provides a guitar with a neck truss rod supporting construction capable of firmly coupling its elements, such as a fret board, a neck, a guitar body and a front board of the guitar body, with one another, by the provisions of an extension member providing a wide bonding area, a coupling member engaged in a block of the guitar body in a dovetail manner and upper walls of the extension member engaged in an opening of the front board in a fit manner. The neck truss rod supporting construction achieves an improvement in constructional firmness. The truss rod support construction and thus the fret board do not move relatively to the guitar body and the neck, so that any relative movement between the truss rod and the neck does not occur even when a variation in the moisture content of the wood material of the neck occurs. Moreover, there is no any phenomenons such as cracking or bowing of the neck. As a result, an improvement in acoustic quality can be obtained.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A guitar comprising a guitar body having a front board and a side board, a neck having a slot receiving a truss rod and a neck truss rod supporting construction, and a fret board attached to the neck, characterized in that said neck truss rod supporting construction comprises:

an elongate, truss rod supporting member adapted to support said truss rod and provided at its rear end with a heel extending downwardly and at its upper surface with a plurality of longitudinal shallow slots for forming a bonding surface;

a coupling member formed at the rear end of the truss rod supporting member behind said heel and integrally connected to the heel, said coupling member extending downwardly from the truss rod supporting member and has a cross-sectional shape of a trapezoid rotated 90°;

an extension member integrally formed with the truss rod supporting member behind the coupling member and provided with a plurality of upper walls extending transversely and defining recesses among them, said extension member also having a plurality of longitudinal shallow slots for forming a bonding surface at an upper surface defined by all the upper walls;

a plurality of throughout holes formed in at least one of the upper walls of the extension member and each adapted to receive a nail or screw;

reinforcing members mounted beneath at least one of the upper walls at both sides of the extension member and adapted to reinforce the upper wall;

a block fixedly mounted to the side board in the guitar body and provided with a first groove having the same cross-sectional shape as that of the coupling member and receiving the coupling member and a second groove receiving the extension member; and an opening formed at the front board of the guitar body and having the same shape as that of the upper surface of the extension member.

* * * * *